US007520197B2

(12) United States Patent
Kingham

(10) Patent No.: US 7,520,197 B2
(45) Date of Patent: Apr. 21, 2009

(54) ROOFING MATERIAL REMOVAL DEVICE

(76) Inventor: James Richard Kingham, P.O. Box 370, Wicomico Church, VA (US) 22579

( * ) Notice: Subject to any disclaimer, the term of this patent is extended or adjusted under 35 U.S.C. 154(b) by 0 days.

(21) Appl. No.: 11/689,009

(22) Filed: Mar. 21, 2007

(65) Prior Publication Data

US 2007/0151422 A1 Jul. 5, 2007

Related U.S. Application Data

(63) Continuation-in-part of application No. 11/208,090, filed on Aug. 19, 2005, now abandoned, which is a continuation-in-part of application No. 10/972,283, filed on Oct. 25, 2004, now abandoned.

(60) Provisional application No. 60/814,360, filed on Jun. 15, 2006.

(51) Int. Cl.
*E04D 15/00* (2006.01)

(52) U.S. Cl. ..... 81/45; 81/463; 299/37.1

(58) Field of Classification Search ..... 81/45, 81/463; 173/135, 210; 299/100, 36.1, 37.1, 299/37.3–37.5
See application file for complete search history.

(56) References Cited

U.S. PATENT DOCUMENTS 3,559,753 A 2/1971 Meri et al.
3,747,690 A * 7/1973 Deike ..... 173/118
4,099,580 A 7/1978 Ross
4,124,922 A * 11/1978 Speedie ..... 24/115 R
4,168,751 A * 9/1979 Deike ..... 173/1
4,470,440 A * 9/1984 Thor ..... 144/195.5
4,663,995 A 5/1987 Amundson et al.
4,691,439 A 9/1987 Marra
4,709,479 A 12/1987 Lavelette
4,747,455 A 5/1988 Cunningham
4,756,578 A 7/1988 Mims et al.
4,763,547 A 8/1988 Dike, Jr.
4,858,503 A 8/1989 Dike, Jr.
4,880,491 A 11/1989 Jacobs et al.
4,948,179 A * 8/1990 Kulikowski et al. ..... 285/316
4,984,639 A * 1/1991 Lindsey et al. ..... 173/100

(Continued)

OTHER PUBLICATIONS

Notification of Transmittal of The International Search Report and The Written Opinion Of the International Searching Authority, or the Declaration mailed Mar. 21, 2008.

(Continued)

*Primary Examiner*—D. S Meislin
(74) *Attorney, Agent, or Firm*—Stanislaus Aksman; Roberts Mlotkowski Safran & Cole P.C.

(57) ABSTRACT

A material removing device for removing materials from a surface includes a body having a handle assembly with a recoil mechanism and a driver slidably mounted to the body. A blade with a slotted edge is removably connected to the driver. An actuator mounted to the body provides a high impact to the driver to slide the blade in the longitudinal direction under the materials to be removed and then pivot the blade upward to pry the materials from the surface. The actuator can be pneumatically powered and activated by a manual or automatic trigger. The device is designed to be used as a hand held roofing tool and exhibits light weight and easy operation.

36 Claims, 6 Drawing Sheets

U.S. PATENT DOCUMENTS

| | | | | |
|---|---|---|---|---|
| 5,001,946 | A | 3/1991 | Shirlin et al. | |
| 5,076,119 | A | 12/1991 | Wenz | |
| 5,113,950 | A | 5/1992 | Kresnoff | |
| 5,218,766 | A | 6/1993 | Himebaugh | |
| 5,462,127 | A | 10/1995 | Svensson | |
| 5,741,047 | A | 4/1998 | Ordonez | |
| 5,800,021 | A | 9/1998 | Derr | |
| 5,863,100 | A | 1/1999 | Martin | |
| 5,884,978 | A | 3/1999 | Bell et al. | |
| 5,906,145 | A | 5/1999 | Shepard | |
| 5,921,155 | A | 7/1999 | Faller et al. | |
| 6,098,292 | A | 8/2000 | Harpell | |
| 6,105,470 | A | 8/2000 | Hutchins | |
| 6,116,117 | A | 9/2000 | Nicolosi et al. | |
| 6,128,979 | A | 10/2000 | Shepard | |
| 6,158,527 | A | 12/2000 | Juuri et al. | |
| 6,318,213 | B1 * | 11/2001 | Hendrix et al. | 81/45 |
| 6,393,948 | B1 | 5/2002 | Hutchins | |
| 6,467,377 | B1 | 10/2002 | Kersting | |
| 6,792,829 | B2 | 9/2004 | Garcia et al. | |
| 6,948,700 | B2 | 9/2005 | Wood | |
| 2003/0173098 | A1 | 9/2003 | Miner et al. | |
| 2004/0227131 | A1 | 11/2004 | Wood | |
| 2006/0086209 | A1 | 4/2006 | Kingham | |
| 2006/0086210 | A1 | 4/2006 | Kingham | |
| 2007/0000354 | A1 * | 1/2007 | Tyler | 81/45 |

OTHER PUBLICATIONS

Notification Concerning Transmittal of International Preliminary Report on Patentability and the Written Opinion of the International Searching Authority Mailed Dec. 31, 2008.

* cited by examiner

ROOFING MATERIAL REMOVAL DEVICE

CROSS-REFERENCE TO RELATED APPLICATIONS

This application claims priority to U.S. Provisional Patent Application Ser. No. 60/814,360 filed Jun. 15, 2006, the entirety of the contents of which is incorporated herein by reference. This application is also a continuation-in-part application of U.S. application Ser. No. 11/208,090 filed Aug. 19, 2005 now abandoned, which is a continuation-in-part application of U.S. application Ser. No. 10/972,283 filed Oct. 25, 2004, now abandoned. The entirety of the contents of both parent applications is incorporated herein by reference.

BACKGROUND OF THE INVENTION

1. Field of the Invention

The invention relates to hand tools, in particularly to pneumatic powered high impact tools. The invention additionally relates to devices for use in removing building materials from a surface.

2. Discussion of Related Art

The most basic way to remove old roofing materials for replacement is to use a shovel to scrape the shingles, felt and nails from the surface of the roof. Any remaining nails must be pried up with the edge of the shovel. The loosened material must also be lifted up from the surface with the shovel. This is a tedious and inefficient process.

Powered tools have been developed to speed the process and to alleviate the manual labor involved. For example, U.S. Pat. No. 6,128,979 discloses a power assisted shovel that has a reciprocating shovel blade. While this device offers powered assistance by vibrating the shovel blade, it does not assist a user in lifting the materials or prying materials still fastened to the surface. Additionally, the vibrating device imparts the vibration to the user and can be physically jarring to a user.

Other devices have provided power assisted lifting mechanisms, such as U.S. Pat. No. 4,691,439 in which a shovel-like device has a pivoting blade. However, the user must still manually insert the blade under the shingles to operate the lifting mechanism.

There is a need for a device that alleviates the difficult manual labor aspects of removing material from a surface. There is also a need for a device that can improve the speed and efficiency of removing materials from a surface.

BRIEF SUMMARY OF INVENTION

An aspect of embodiments of the device relates to providing a device that provides a high impact for moving the device under materials to be removed.

Another aspect of embodiments of the device relates to providing a device that also provides a strong leveraging force to lift materials from a surface.

A further aspect of embodiments of the device relates to providing a tool that is easy for a user to operate and lightweight for ease of manipulation.

An additional aspect of embodiments of the device relates to protecting a user from the force of recoil when operating the device.

The invention is directed to a material removal device comprising a body having a longitudinal axis; a handle element coupled to the body, a driver slidably supported by the body generally parallel to the longitudinal axis and having a first end and a second end, and a blade pivotally coupled to the first end of the driver. An actuator is mounted to the body and has an impactor selectively engageable with the second end of the driver to move the driver in a single stroke with respect to the body that translates into a first high impact longitudinal stroke of the blade and a second rotatable stroke of the blade. A controller is coupled to the actuator to selectively drive the impactor.

The invention is also directed to a material removal device comprising an elongated body with a handle, a driver slidably mounted to the body, a blade pivotally connected to the driver, and a power actuator mounted to the body that moves the driver to consecutively slide the blade and then pivot the blade with each stroke of the driver.

The invention is further directed to a hand held roofing tool for removing materials from a surface comprising an elongated body having a handle mount and a driver mount, a handle assembly slidably mounted to the handle mount of body, including at least one handle and a recoil spring disposed between the at least one handle and the handle mount, and a driver slidably mounted to the driver mount of the body, wherein the driver has a first end and a second end and a return mechanism supported on the driver to bias the driver into a ready position. A blade is pivotally coupled to the first end of the driver and having a linkage coupled to the body, wherein the blade is biased into a driving position and is rotatable into a tilted position. An actuator is mounted to the body with an impactor that connects with the driver with a high impact to drive the driver in a longitudinal direction for a first distance in which the blade slides in the driving position and for a second distance in which the blade rotates into the tilted position. A trigger is coupled to the actuator for activating the impactor to impact the driver.

These and other aspects of the device will become apparent when taken in conjunction with the drawings and detailed description.

BRIEF DESCRIPTION OF THE DRAWINGS

The invention will now be described in conjunction with the accompanying drawings in which.

In the drawings, like reference numerals indicate corresponding parts in the different figures.

DETAILED DESCRIPTION OF PREFERRED EMBODIMENTS

The device described herein is explained in the context of a tool for removing roofing materials including shingles, roofing underlayment, and fasteners. However, it will be understood by those of ordinary skill in the art that the device can be used to remove or unfasten any type of building material from a surface, including but not limited to tiles from a floor and clapboard from a wall, for example.

Figure 1:
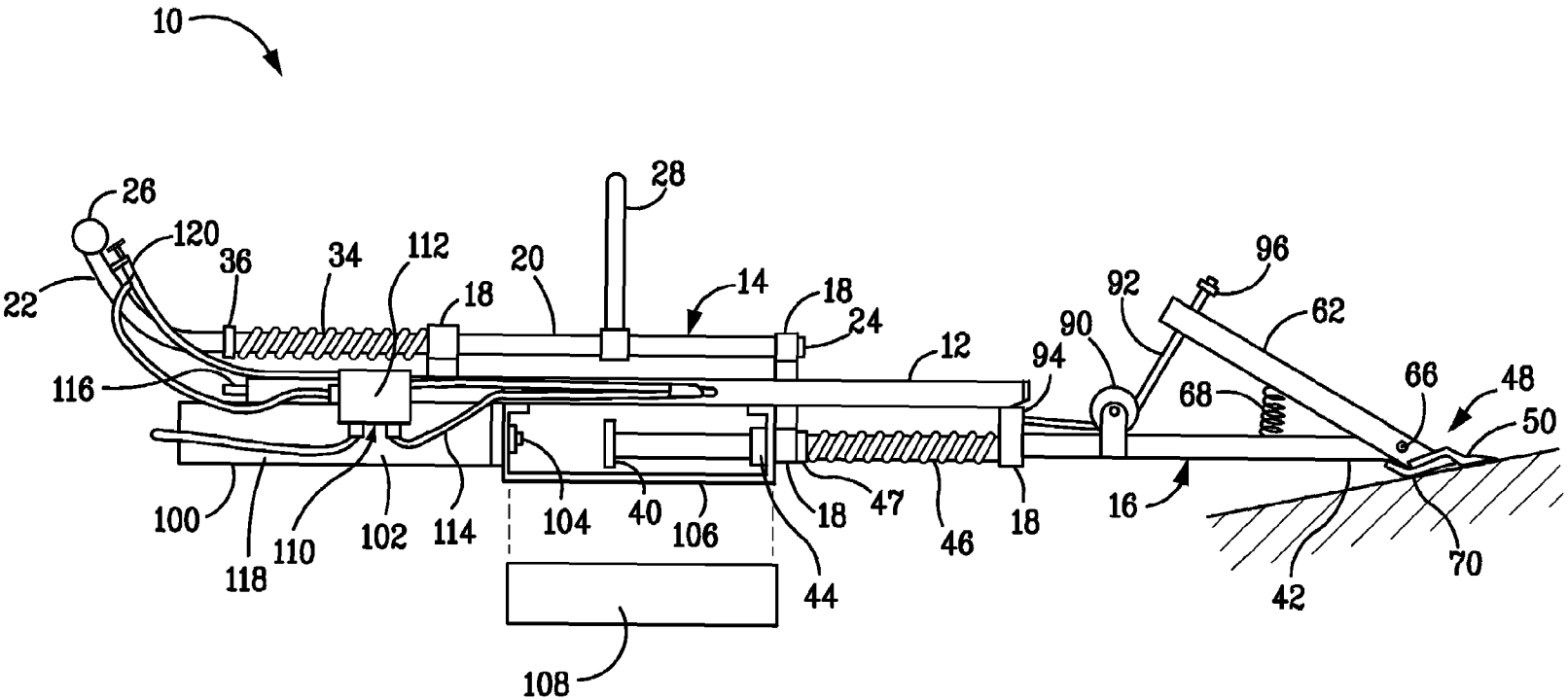
FIG. 1 is a side view of the device in accordance with the invention having a manual operating mechanism.

Referring to FIG. 1, a material removal device 10 is shown as a hand-held roofing tool. The device 10 includes a main body 12 having a longitudinal axis. A handle element 14 is coupled to the one side of the body 12, and a driver 16 is mounted to the other side of the body 12. The body 12 is formed as a rigid element that can be formed as a hollow tube. The elements of the device 10 are preferably formed of a high strength material, such as metal, in particular steel. The body 12 can be made of 4130 N steel, for example, for strength, shock and bending resistance and light weight. Of course, titanium, composites, carbon fiber materials, or even reinforced synthetics or fiberglass could also be used to reduce the weight of the device 10.

Figure 5:
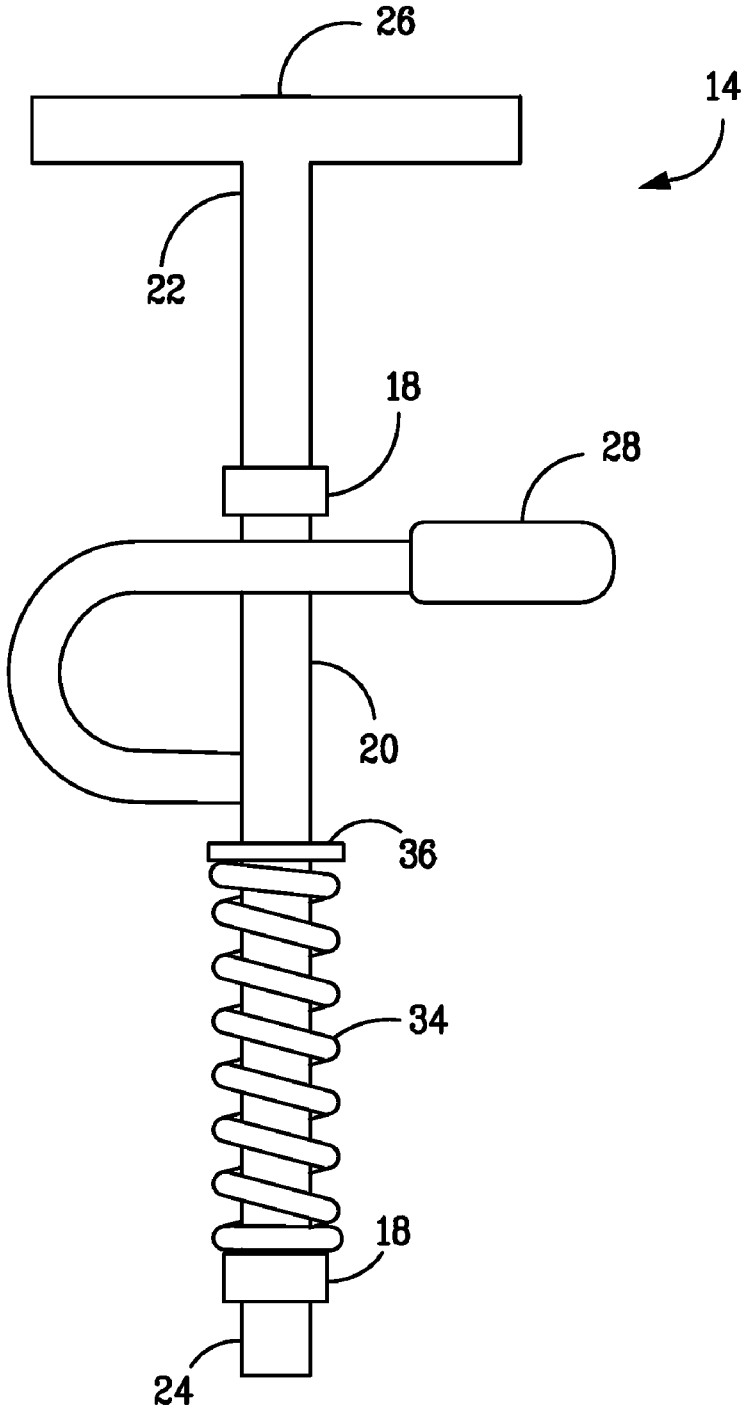
FIG. 5 is a top view of the handle element of the device of FIG. 1.

The handle element 14 is coupled to the body 12 by a bushing, or in this case, by a pair of bushings 18, along the longitudinal axis of the body 12. The handle element 14 is formed as an elongated stem 20 with a first end 22 that is angled away from the longitudinal axis and a second end 24. The handle element 14 can be made of a more light weight material, such as aluminum. As seen in FIG. 5, a first handle 26 is disposed on the first end 22 and has a T-shape to assist manual gripping by both hands or by either hand of a user. A second handle 28 is disposed on the stem 20 to assist with manipulating the device 10. The second handle 28 can have a C-shape so as to extend above the stem 20, as seen in FIG. 1, and curve over the stem 20. The second handle 28 can extend from either side of the stem 20 for use by a right or left handed operator as the grip is centrally positioned. Of course, if desired the second handle 28 could also have a T-shape for grasping on either or both sides.

Figure 8:
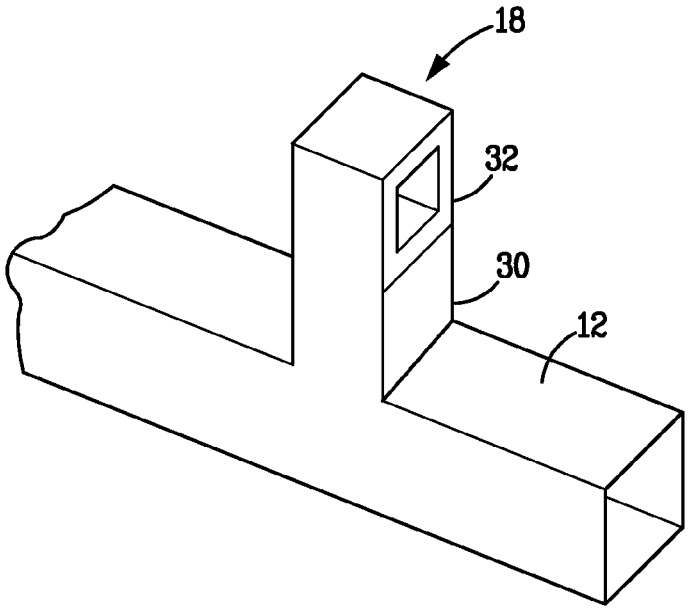
FIG. 8 is a partial side perspective view of the bushings for use with the device.

The bushings 18, as seen in detail in FIG. 8, are designed to allow the handle element 14 to slide with respect to the body 12. To avoid twisting of the handle element 14, the stem 20 can be formed as a polygonal shape or some other non-circular shape. In this case, the stem 20 is formed as a square tube, which imparts strength and rigidity, while the first and second handles 26, 28 are rounded for ease of grasping by a user. The handles 26, 28 can be made of tubes or pipes and can be bent into a desired shape by a tubing bender, if desired. The bushing 18 includes a spacer portion 30 and a receiving portion 32. In this case, the spacer portion 30 and receiving portion 32 are formed as portions of a square tube for simplicity and cost savings. The stem 20 can slide within the receiver portion 32. Of course, any type of durable connector elements could be used.

The handle element 14 also includes a recoil cushioning mechanism, the operation of which is described below. The recoil cushioning mechanism includes a spring 34 and a stop 36 mounted on the stem 20. The spring 34 is positioned adjacent a bushing 18, either between the first handle 26 and bushing 18, as seen in FIG. 1, or between the second handle 28 and bushing 18, as seen in FIG. 5. In either case, the stop 36 is fixed on the stem 20 and cushions the sliding force of the handle element 14.

The driver 16 is mounted to the body 12 in a similar manner with bushings 18, as seen in FIG. 1. The driver 16 is also an elongated element that is mounted in a non-rotatable manner. To accomplish this, the driver 16 can be formed as a non-circular element, such as a square tubular element, again providing high rigidity and strength. The driver 16 has an impacted end 40 and a tool mounting end 42. A shock absorber 44 is mounted adjacent to the impacted end 40 and a bushing 18 to provide a cushion between the impacted end 40 and the bushing 18 when the driver 16 slides with respect to the body 12. A return spring 46 is supported by the driver 16 between the mounts, in this case the bushings 18, to bias the driver 16 into a resting position. A stop 47 is fixed to the driver 16 adjacent to the spring 46. At the tool mounting end 42, a material removing tool 48 is pivotally mounted.

Figure 2:
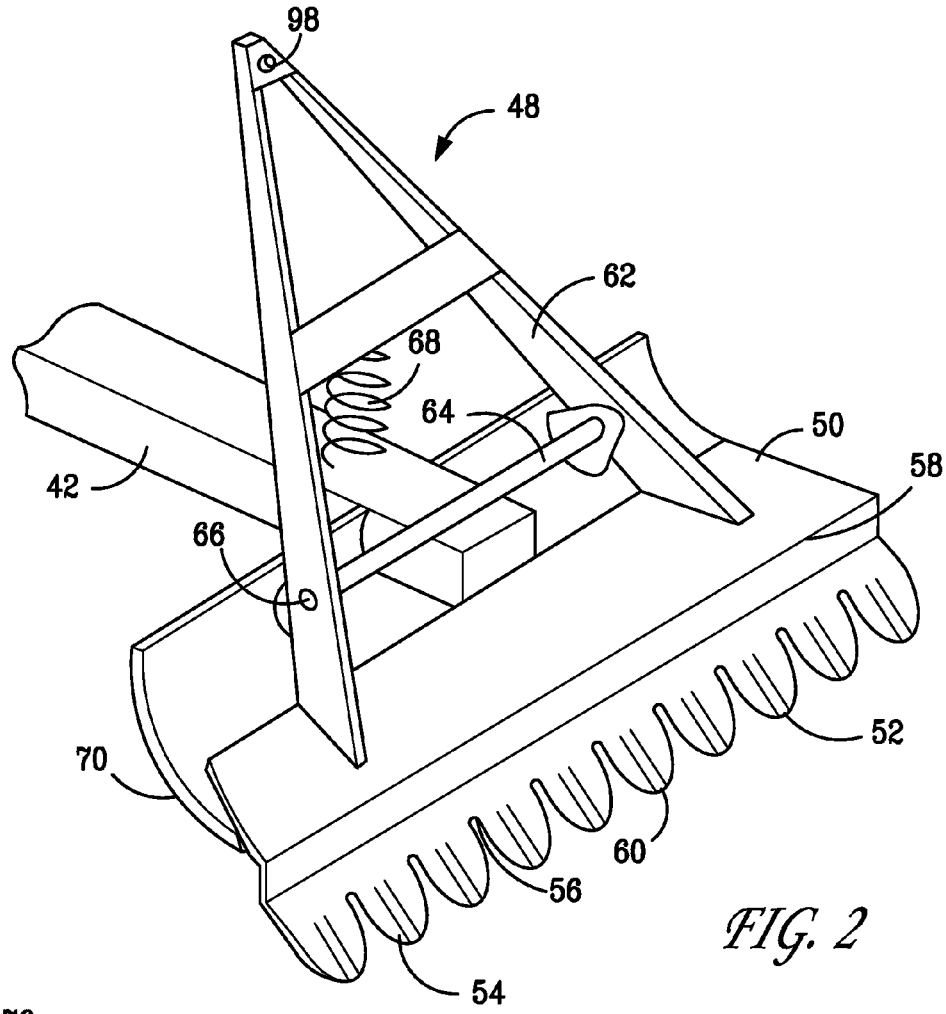
FIG. 2 is a front perspective view of the blade of the device of FIG. 1.

One embodiment of the material removing tool 48 is seen in detail in FIG. 2. The tool 48 is in the form of a blade 50. The blade 50 is a plate like member with a leading edge 52 shaped to assist in the removal of material. The blade 50 can be made of stamped alloy steel. The leading edge 52 is formed as a plurality of teeth 54 with slots 56 formed between each tooth. The leading edge 52 may be beveled and the teeth 54 may be slightly rounded to assist the blade 50 in sliding under materials, such as shingles and felt, and around fasteners extending through the roofing materials. The teeth 54 are pointed downward from a ledge 58 so as to slide under material to be removed. The ledge 58 creates a step down to the leading edge 52. The slots 56 are shaped to receive a fastener shank and loosely secure the shank for removal by prying and then allow the fastener to slide free for disposal. Each tooth 54 can have a rib 60, which strengthens the teeth and avoids deformation during use. Any suitable tool could be used, including other types of blades, pry bars, shovels, etc.

The blade 50 is pivotally coupled to the tool mounting end 42 of the driver 16 by a lever 62 and a pivot bar 64. The lever 62 is rigidly secured to the blade 50, and the pivot bar 64 is rigidly secured to the tool mounting end 42. A pivot rod 66 extends within pivot bar 64 and is secured to the lever 62. The pivot rod 66 and pivot bar 64 are rotatable with respect to each other, which causes the blade 50 to pivot with respect to the driver 16. A biasing element, in this case spring 68, is mounted between the lever 62 and the tool mounting end 42 to bias the blade 50 into a neutral position. Other configurations of the lever are possible, including a compound multi-bar lever to provide additional lifting assistance. A rotation plate 70 is secured to the tool mounting end 42 and provides a curved surface to rest the device 10 against a surface for material removal.

The curved surface of the rotation plate 70 creates a fulcrum about which the device 10 can be manually pivoted. The ledge 58 of the blade 50 extends across the edge of the rotation plate 70, which causes the leading edge 52 of the blade 50 to be stepped down and thus positioned closer to the fulcrum of the rotation plate 70. During use, the fulcrum of the tool 10 against the surface is close to the edge of the rotation plate 70 and, as the tool 10 is pivoted against the surface, the rotation plate 70 tilts and the fulcrum shifts backward with respect to the blade 50. The step in the blade 50 created by the ledge 58 minimizes the distance between the blade leading edge 52, the bottom of the slots 56, and the forward edge of the rotation plate 70. This reduces the lifting action felt by the user during use. It also offers a lower profile to the tool 48, which assists in sliding the leading edge 52 under materials to be removed. The step in the blade 50 created by the ledge 58 has a height that allows the forward edge of the rotation plate 70 to nest in the step of the blade 50 to permit the rotation plate 70 to slide over the surface without impediment from small protrusions on the surface.

Figure 3:
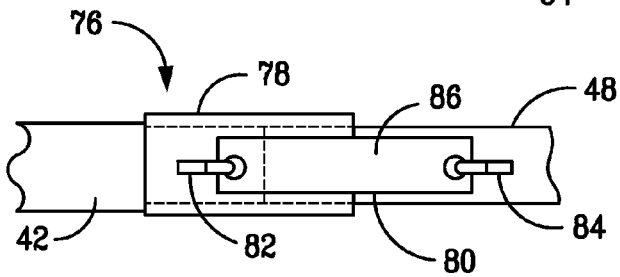
FIG. 3 is a top view of a connection mechanism for attaching the blade to the body of the device.
Figure 4:
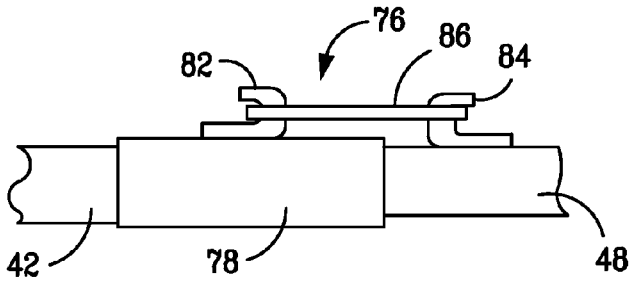
FIG. 4 is a side view of the connection mechanism of FIG. 3.

The tool 48 can be removed and replaced with another tool 48 for repair or with a different tool for an alternative use. For example, different blades may be used for to accommodate roofs with different pitches or to remove different types of fasteners. FIGS. 3 and 4 show a connector 76 that can be used to attach a tool 48 to the device 10. The connector 76 includes a sleeve 78 and a fastener 80. The fastener 80 is formed as a pair of hooks 82, 84 and a strap 86. One hook 82 is carried by the sleeve 78, and the other hook 84 is carried by the tool 48. The strap 86 is selectively attached to the hooks 82, 84 to secure the tool 48 onto the tool mounting end 42 of the driver 16. The strap 86 can be formed of any strong resilient material, such as polyurethane. This type of connection is very durable and not subject to fatigue experienced by other types of connectors. Fatigue is an important consideration especially in dry fire situations where the device is accidentally actuated with no resisting surface, which causes the tool end to experience stronger forces at the connection point. Of course, other fastening systems could be used including clamps, bolts, or interlocking formations.

As noted above, the blade 50 is pivotally mounted on the end of the driver 16. The blade 50 is normally positioned in a neutral or driving position due to the spring bias action from spring 68. To actuate the pivoting function of the blade 50, a linkage is provided. As seen in FIG. 1, the linkage in this case is formed as a pulley 90 and cable 92. The pulley 90 is mounted at a fixed position to the driver 16. The cable 92 has one end 94 fixed at the end of the body 12, to a bushing 18, for example. The other end 96 has a stop and is connected to the lever 62 through a sliding connection, such as through an aperture or grommet 98. The cable 92 has a length that exceeds the distance from the end of the body 12 through the pulley 90 to the lever 62. The cable 92 has a high tensile strength so that the length does not change upon application of a tensile force. The cable 92 can be made of braided steel or wire, for example.

Referring again to FIG. 1, the device 10 also includes an actuator 100 mounted on the body 12. The actuator 100 provides a high impact force to strike the driver 16 and drive the tool 48 in a forward direction. In this case, the actuator 100 is a pneumatic cylinder 102 connectable to a pressurized fluid source. As is known, the pneumatic cylinder 102 includes a chamber and piston that is driven by selective introduction of pressured gas. The cylinder 102 could be a single acting air cylinder, which uses less air per cycle than a double acting cylinder. The cylinder 102 can have an internal return spring (not seen) that returns the piston to the starting position. The pressurized fluid source can be an air compressor capable of producing at least 4.0 cubic feet of air per minute at 80-200 pounds per square inch gauge. Of course, other types of actuators can be used, including hydraulic cylinders and high load springs, for example.

An impactor 104 is connected to the piston and is responsive to movement of the piston to move at a high velocity to strike the impacted end 40 of the driver 16 and push the driver 16 in a longitudinal direction with respect to the body 12 until the impacted end 40 hits the shock absorber 44. A crash box or housing 106 is mounted to the body 12 at a position between the actuator 100 and the bushing 18 that supports the driver 16. The housing 106 can be formed, for example, as a bracket welded to the body to encase the impactor 104 and impacted end 40 of the driver 16 and isolate the impact shock from the body 12. The housing 106 also provides structural support to the body 12 in order to resist deflection of the body 12 during impact and assists in halting the forward motion of the impacted end 40 of the driver 16 along with the shock absorber 44. The shock absorber 44 functions to reduce the force transmitted to the operator of the device 10 and limits the stroke of the piston of the cylinder 102. A cover 108 is provided to enclose the housing 106 and also to provide protection to a user and to muffle the noise of the impact.

A controller 110 is connected to the actuator 100 to control activation of the impactor 104. The controller 110 can be any type of control mechanism suitable for controlling the particular type of actuator, including mechanized or electronic systems. In this case, the controller 110 includes a valve assembly that controls flow of the pressurized fluid from a pressurized fluid source to the pneumatic cylinder 102. The controller 110 includes a three-way power valve 112 that has an air supply hose 114 connected to the body 12. As noted above, the body 12 is preferably a hollow tube. An air inlet fitting 116 is provided on the body for connection to a pressurized fluid source. The body 12 acts as an accumulator and a manifold for the pressurized fluid. So, the fluid enters the body 12 and is stored there until allowed to communicate with the pneumatic cylinder 102 through the air supply hose 114 via power valve 112 and air supply hose 118. A manual trigger assembly 120 is provided near the handle 26 to permit manual activation of the controller 110. Upon manipulation of the trigger assembly 120, the pressurized fluid supply within the body 12 is tapped and allowed to communicate with the actuator 100 via the controller 110 valve system. The manual trigger assembly 120 can be a push button valve. In operation, the push button can be held down by an operator until the cylinder 102 completes a full stroke.

Figure 6:
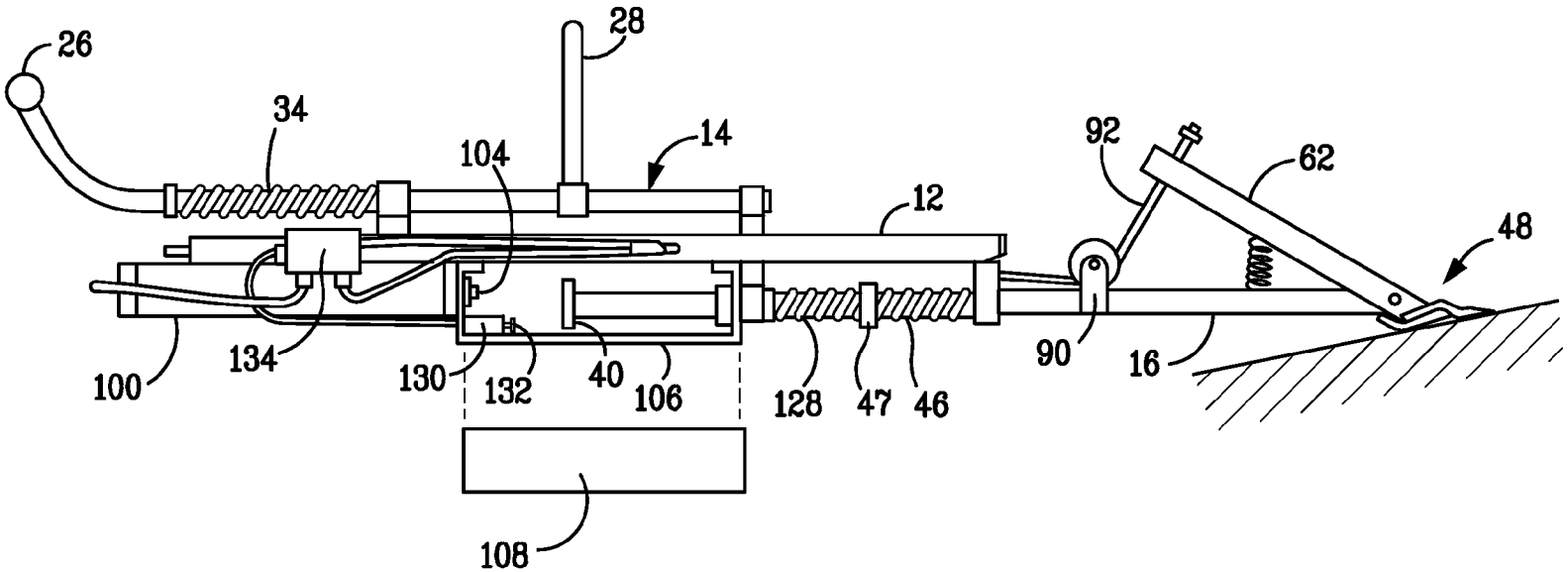
FIG. 6 is side view of the device in accordance with the invention having an automatic operating mechanism.
Figure 7:
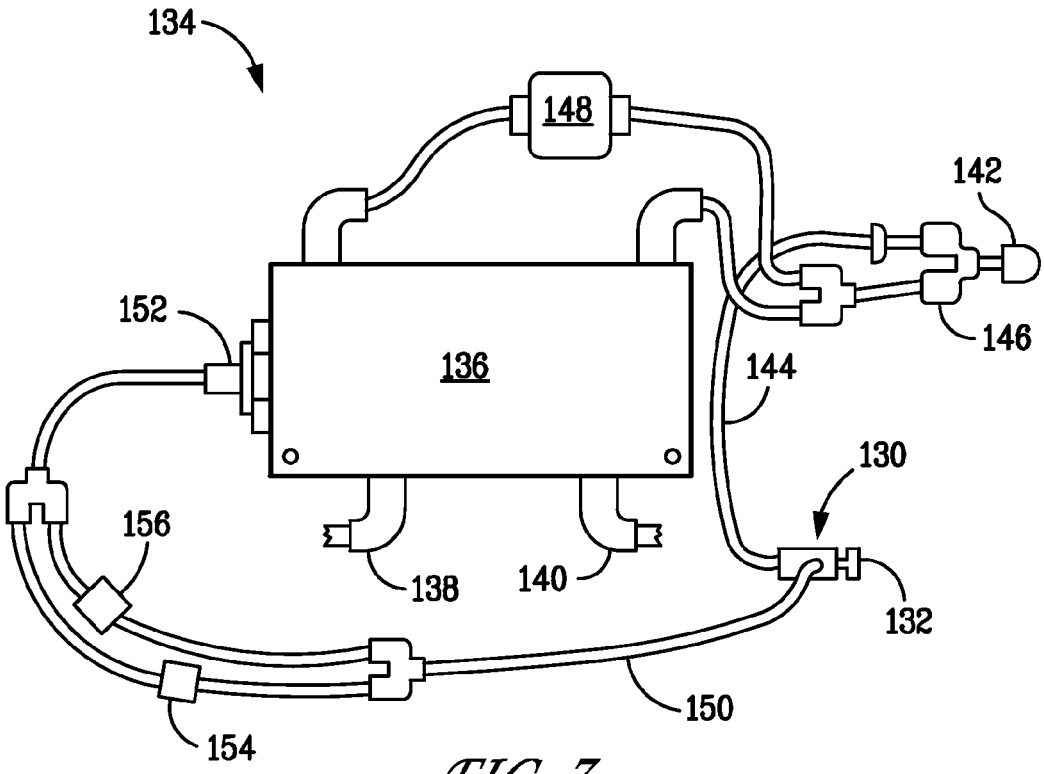
FIG. 7 is a schematic side view of the actuating and control systems of the device of FIG. 6.

If desired, the manual trigger assembly 120 can be replaced with an automatic trigger assembly 130, seen in FIGS. 6 and 7. In this case, the trigger assembly 130 is mounted adjacent to the impactor 104 and the impacted end 40 of the driver 16 within the housing 106. An automatic trigger resistance spring 128 is provided on the driver 16 between the bushing 18 and the stop 47. The trigger assembly 130 is activated when the impacted end 40 pushes against the plunger 132 in response to a user pushing the device 10 in a forward direction and biasing the driver 16 against a surface to cause the driver 16 to slide back with respect to the body 12 toward the actuator 100. The automatic trigger resistance spring 128 provides a degree of resistance against the driver 16 sliding back toward the automatic trigger to prevent accidental firing. The return spring 46 functions in the same way as in the manual embodiment by biasing the driver 16 into a neutral position. So, when the device 10 is pushed against a surface, the resistance experienced by the device 10 automatically activates the actuator 100 to strike the driver and drive the tool 48 forward with a high impact.

The controller 134 used with the automatic trigger assembly 130 is shown in a simplified manner for clarity in FIG. 6 and in a detailed manner in FIG. 7. A four-way power valve 136 is mounted on the body 12 and is connected to the actuator 100 via supply hoses 138 and 140. The main fluid supply is accomplished through supply fitting 142 connected to the body 12. A pilot valve trigger inlet tube 144 extends from the trigger 130 to the fitting 142 via a Y connector 146. Upon activation of the plunger 132, fluid is released through connector 146 to the power valve 136 via a pressure regulator 148. A pilot valve outlet tube 150 extends from the pilot valve 152 to the trigger 130. A check valve 154 and flow restrictor 156 are also provided. To prevent premature stoppage of fluid to the cylinder 102, which would cause an incomplete stroke, a delay is incorporated in the pilot valve closing. This is accomplished by slowing the exhaust on the pilot valve 152 by using the check valve 154 on the outlet tube 150 from the trigger 130 to the pilot valve 152 and restricting the air flow with flow restrictor 156 on the exhaust line from the pilot valve 152. A battery powered electrical switching system could also be employed to provide a timed reciprocal activation of the power valve 136. Either type of air cylinder, a single acting or a double acting, could be used with the automatic trigger assembly 130 and controller 134. Of course, any suitable control system can be utilized to selectively activate the actuator and control fluid flow.

Figure 9:
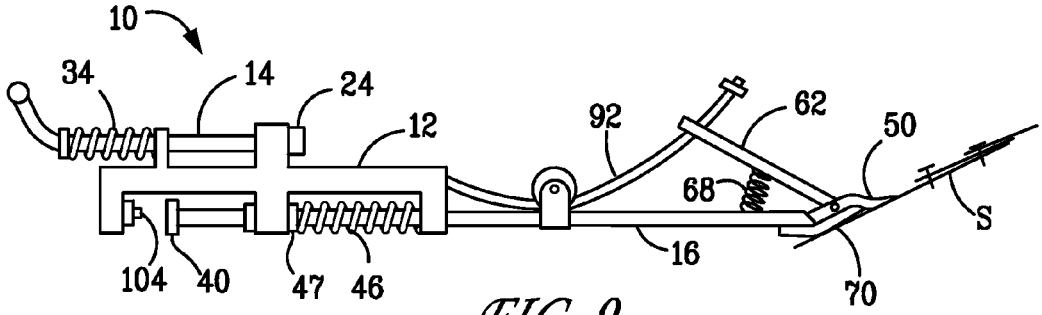
FIG. 9 is a schematic side view of the device in a first operating position.

FIGS. 9-12 schematically illustrate the operation of the device 10. Either trigger arrangement can be used, either manually operated by a user or in response to resistance imposed on the device 10. Referring to FIG. 9, the device 10 is in the neutral position with the rotation plate 70 resting on a surface S and the blade 50 extending forward due to the biasing force of spring 68. The driver 16 is biased by spring 46 into a resting position in which the impacted end 40 is spaced from the impactor 104.

Figure 10:
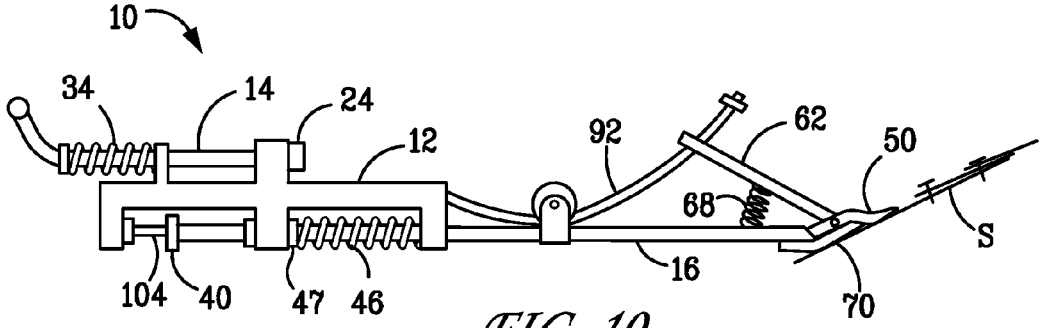
FIG. 10 is a schematic side view of the device in a second operating position.

FIG. 10 illustrates the striking moment when the controller 110 has activated the actuator 100 either by manipulation of trigger assembly 120 or as a response to movement of the driver 16 against trigger assembly 130 due to pressing against the surface S. Here, the handle 14 remains in the same initial position, while the impactor 104 strikes the impacted end 40 at a high velocity with a high force.

Figure 11:
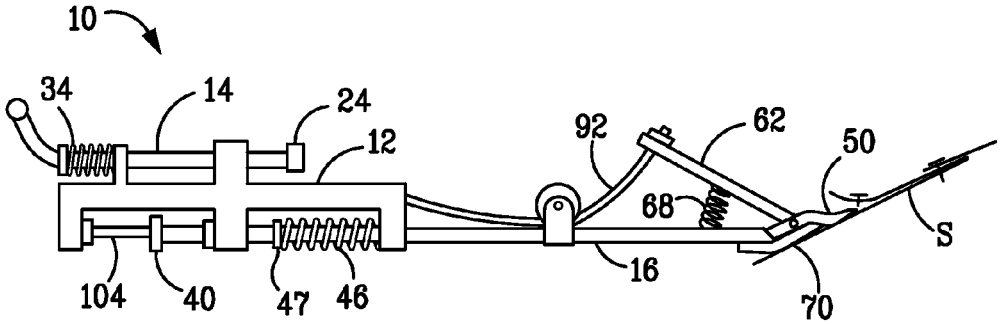
FIG. 11 is a schematic side view of the device in a third operating position.

FIG. 11 shows the next stage of operation during which the actuator 100 drives the driver 16 in a forward direction toward the surface S. In this position, the blade 50 is driven under the materials on the surface S. In this position, the handle 14 slides with respect to the body 12 and the spring 34 compresses, thus cushioning a user holding the handle assembly 14 from the recoil of the device due to the striking force of the actuator 100. The impacted end 40 also moves in a forward direction and spring 46 compresses due to the movement of stop 47. This also provides a cushioning effect for the user. As seen, driver 16 moves forward with the blade 50 thrusting forward, but still in the same position as it began due to the bias of spring 68. This is due to the slack in the cable 92, which allows the driver 16 to slide for a predetermined distance without activating the lever 62.

Figure 12:
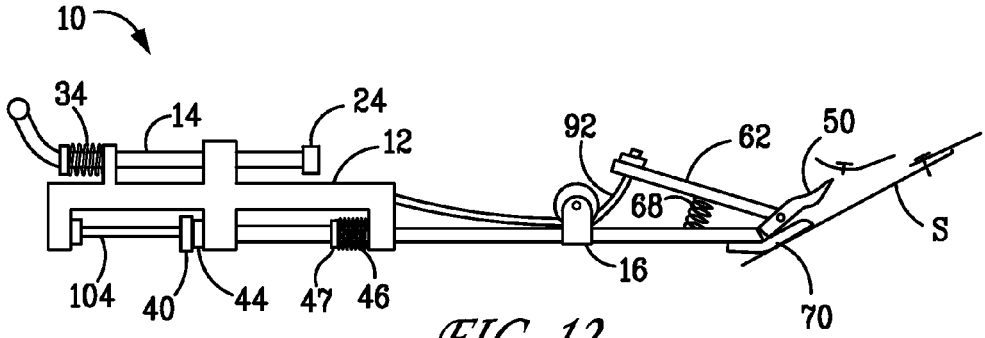
FIG. 12 is a schematic side view of the device in a fourth operating position.

FIG. 12 illustrates the point at which the blade 50 is pivoted upwardly to provide a lifting force to the device 10 to lift the materials from the surface with the leading edge of the blade 50. In this position, the impactor 104 is fully extended with the impacted end 40 impinging on the shock absorber 44 to cushion the end of the stroke of the driver 16. Spring 46 is fully compressed by stop 47 and is ready to return the driver 16 to the neutral position. The handle assembly 14 has slid forward and spring 34 is compressed and is ready to bias the handle assembly 14 back to the start position. The cable 92 has engaged the lever 62 and pulled the lever 62 toward the driver 16, thus compressing the spring 68 and causing the blade 50 to pivot upwardly and provide a power lift to the materials on the surface S. If desired, the lever 62 can be formed as a compound lever, for example a four bar mechanism, to improve the mechanical advantage of the lifting force. The rotation plate 70 remains on the surface S. The teeth 54 and slots 56 act to pry the fasteners from the surface S.

The spring biased action of the tool 10 automatically returns the tool to the ready position after each full stroke of the driver 16. This allows for rapid cycling, particularly with the automatic trigger assembly 130.

It can be appreciated from the description that the recoil force generated from the high impact stroke of the actuator 100 is greatly diminished due to the spring biased handle assembly 14. The impact force experienced by the user is also diminished due to the shock absorber 44 and spring 46. This makes the device 10 more comfortable to use and less fatiguing for workers. The dual action of the striking and pivoting action of the tool 48 also provides a very powerful device that both scrapes and lifts material from a surface in an efficient and highly effective manner. It will be appreciated by those of ordinary skill in the art that a larger amount of material may be removed in less time with the use of this tool.

Various modifications can be made in my invention as described herein, and many different embodiments of the device can be made while remaining within the spirit and scope of the invention as defined in the claims without departing from such spirit and scope. It is intended that all matter contained in the accompanying specification shall be interpreted as illustrative only and not in a limiting sense.

What is claimed is:

1. A material removal device, comprising:

a body having a longitudinal axis;

a handle element coupled to the body;

a driver slidably supported by the body generally parallel to the longitudinal axis and having a first end and a second end;

a blade pivotally coupled to the first end of the driver;

an actuator mounted to the body and having an impactor selectively engageable with the second end of the driver to move the driver in a single stroke with respect to the body that translates into a first high impact longitudinal stroke of the blade and a second rotatable stroke of the blade; and a controller coupled to the actuator to selectively drive the impactor.

2. The material removal device of claim 1, wherein the blade is pivotally coupled to the first end of the driver with a spring biased lever, wherein the lever has a first end connected to the blade and a second end connected to the body.

3. The material removal device of claim 2, wherein a pulley is fixedly mounted to the driver, and a cable having a fixed length is connected from the body through the pulley to the second end of the lever.

4. The material removal device of claim 3, wherein the fixed length of the cable is more than a distance measured between the second end of the lever under the pulley to the body so that a stroke of the driver first drives the blade in a longitudinal direction without engaging the lever and then causes the cable to pivot the lever and rotate the blade.

5. The material removal device of claim 1, further comprising a rotation plate having a curved surface coupled to the first end of the driver adjacent to the blade for contacting a surface on which material is to be removed.

6. The material removal device of claim 5, wherein the rotation plate is supported under the blade and the blade has a leading edge that extends past the rotation plate and is stepped down from a ledge formed in the blade to shorten a distance from the leading edge to the rotation plate.

7. The material removal device of claim 1, wherein the blade includes a plate coupled to the driver and a leading edge that is angled from the plate to extend downward toward a surface for material removal.

8. The material removal device of claim 1, wherein the blade is removably coupled to the driver.

9. The material removal device of claim 1, wherein the first end of the driver has a driver mounting formation and the blade has a blade mounting formation that mates with the driver mounting formation.

10. The material removal device of claim 9, further comprising a resilient connector coupled to the first end of the driver and the blade to removably connect the blade to the driver.

11. The material removal device of claim 1, wherein the blade has a leading edge that is slotted.

12. The material removal device of claim 11, wherein the leading edge includes a plurality of shaped teeth.

13. The material removal device of claim 11, wherein the slots are shaped to receive fastener shanks.

14. The material removal device of claim 1, wherein a housing is provided on the body that encases the impactor and the second end of the driver.

15. The material removal device of claim 1, wherein the body has a connector to a power source.

16. The material removal device of claim 15, wherein the connector is adapted to receive pressurized fluid and the body includes a hollow chamber for storage of the pressurized fluid.

17. The material removal device of claim 16, wherein the controller is in fluid communication with the body and includes a valve assembly to control fluid flow to the actuator.

18. The material removal device of claim 16, wherein the actuator is a pneumatic cylinder with a piston and the impactor is connected to the piston.

19. The material removal device of claim 16, wherein the controller includes a trigger mounted on the handle that selectively permits pressurized fluid to flow to the actuator.

20. The material removal device of claim 1, wherein the actuator is a pneumatic cylinder with a piston and the impactor is connected to the piston.

21. The material removal device of claim 1, wherein the controller includes a trigger mounted on the handle that permits manual activation of the actuator.

22. The material removal device of claim 1, wherein the controller includes an automatic trigger mounted adjacent to the driver that is engaged by the driver in response to force applied to the driver.

23. The material removal device of claim 1, further comprising a shock absorber mounted between the body and the driver to absorb force from the high impact stroke of the blade.

24. The material removal device of claim 1, wherein a spring is mounted on the driver to return the driver to a ready position after each stroke.

25. The material removal device of claim 1, wherein the handle element includes a longitudinal stem with a first handle on one end and a second handle longitudinally spaced therefrom, wherein the stem is mounted on the body along the longitudinal axis.

26. The material removal device of claim 25, wherein the stem is slidably mounted to the body and a recoil spring is supported on the stem to cushion the handle element from the high impact stroke.

27. A material removal device, comprising:

an elongated body with a handle;

a driver slidably mounted to the body;

a blade pivotally connected to the driver;

a power actuator mounted to the body that moves the driver to consecutively slide the blade and then pivot the blade with each stroke of the driver;

a controller coupled to the power actuator to selectively actuate the driver, the controller connectable to a pressurized fluid source; and wherein the power actuator includes a pneumatic cylinder and a piston, the piston impacting the driver to move the driver.

28. The material removal device of claim 27 wherein the controller includes a trigger mounted on the handle that is manually activated.

29. The material removal device of claim 27 wherein the controller includes a trigger that is automatically activated based on force applied to the driver.

30. The material removal device of claim 27, wherein the handle is slidably mounted to the body with a recoil device to cushion impact of the driver.

31. The material removal device of claim 27, wherein the blade has a stepped leading edge with slotted teeth.

32. The material removal device of claim 27, wherein the blade and rotation plate are removably mounted to the driver with a strap and hook assembly.

33. A material removal device comprising:

an elongated body with a handle;

a driver slidably mounted to the body;

a blade pivotally connected to the driver;

a power actuator mounted to the body that moves the driver to consecutively slide the blade and then pivot the blade with each stroke of the driver;

a lever extending from the blade;

a connector that pivotally couples the lever to the body so that the lever pivots in response to movement of the driver; and wherein the connector comprises a pulley mounted to the driver and a cable extending from the body through the pulley to the lever, and the cable includes a slack portion that permits the driver to slide for a distance before the cable exerts a force on the lever.

34. A hand held roofing tool for removing materials from a surface, comprising:

an elongated body having a handle mount and a driver mount;

a handle assembly slidably mounted to the handle mount of body, including at least one handle and a recoil spring disposed between the at least one handle and the handle mount;

a driver slidably mounted to the driver mount of the body, wherein the driver has a first end and a second end and a return mechanism supported on the driver to bias the driver into a ready position;

a blade pivotally coupled to the first end of the driver and having a linkage coupled to the body, wherein the blade is biased into a driving position and is rotatable into a tilted position;

an actuator mounted to the body with an impactor that connects with the driver with a high impact to drive the driver in a longitudinal direction for a first distance in which the blade slides in the driving position and for a second distance in which the blade rotates into the tilted position; and a trigger coupled to the actuator for activating the impactor to impact the driver.

35. The tool of claim 34, wherein the linkage comprises a lever connected with a pulley and cable.

36. The tool of claim 34, wherein the actuator is a cylinder with a pressurized fluid driven piston, with the impactor being connected to the piston.

* * * * *